US006240869B1

(12) United States Patent
Gaber

(10) Patent No.: US 6,240,869 B1
(45) Date of Patent: Jun. 5, 2001

(54) WATERCRAFT STABILIZATION APPARATUS

(76) Inventor: Benny Gaber, 29 Oren Street, Haifa 34735 (IL)

( * ) Notice: Subject to any disclaimer, the term of this patent is extended or adjusted under 35 U.S.C. 154(b) by 0 days.

(21) Appl. No.: 09/463,356

(22) PCT Filed: May 28, 1998

(86) PCT No.: PCT/IL98/00250

§ 371 Date: Apr. 5, 2000

§ 102(e) Date: Apr. 5, 2000

(87) PCT Pub. No.: WO99/05022

PCT Pub. Date: Feb. 4, 1999

(30) Foreign Application Priority Data

Jul. 25, 1997 (IL) ..... 121396

(51) Int. Cl.[7] ..... B63B 39/00
(52) U.S. Cl. ..... 114/126; 114/122
(58) Field of Search ..... 114/121, 125, 114/126, 144 E

(56) References Cited

U.S. PATENT DOCUMENTS

| | | | | |
|---|---|---|---|---|
| 3,324,815 | | 6/1967 | Morales | 114/66.5 |
| 3,373,710 | | 3/1968 | Steinberg | 114/39 |
| 3,727,572 | | 4/1973 | Nelson et al. | 114/126 |
| 3,896,755 | | 7/1975 | Marbury | 114/126 |
| 3,937,423 | * | 2/1976 | Johansen | 244/3.22 |
| 3,990,384 | | 11/1976 | Reynolds, III | 114/126 |
| 4,061,102 | | 12/1977 | Bissett | 114/122 |
| 4,077,077 | | 3/1978 | Harper | 9/310 |
| 4,380,206 | * | 4/1983 | Baitis et al. | 114/122 |
| 4,628,853 | | 12/1986 | Hoyt | 114/274 |
| 4,686,923 | | 8/1987 | Greene | 114/140 |
| 4,718,872 | | 1/1988 | Olson et al. | 440/1 |
| 5,029,548 | | 7/1991 | Bernitsyn et al. | 114/272 |
| 5,408,948 | | 4/1995 | Arii et al. | 114/274 |
| 5,452,674 | | 9/1995 | Melville et al. | 114/122 |
| 5,488,919 | * | 2/1996 | Ferreiro et al. | 114/122 |

FOREIGN PATENT DOCUMENTS

| | | |
|---|---|---|
| 7303664 | 7/1973 | (DK) . |
| 0 591 366 | 10/1996 | (EP) . |
| 2282364 | 3/1976 | (FR) . |
| 1350451 | 4/1974 | (GB) . |
| 1492905 | 11/1977 | (GB) . |
| 2116242 | 8/1976 | (RU) . |
| WO 89/11414 | 11/1989 | (WO) . |
| WO 93/00255 | 1/1993 | (WO) . |

OTHER PUBLICATIONS

Abstract of GB 768127.
Abstract of GB 7435635.
Derwent Abstract of FR2282364A of Mar. 1976.

* cited by examiner

*Primary Examiner*—Ed Swinehart
(74) *Attorney, Agent, or Firm*—Ladas & Parry

(57) ABSTRACT

Stabilization apparatus (12) for a watercraft (10) having a hull (14), including at least one hydrofoil (20) with a leading edge (22) and a trailing edge (24), the edges defining a chord (26) extending therebetween, the at least one hydrofoil being mounted below an underside of the hull and arranged for rotation about an axis (30) that is generally perpendicular to the chord and directed towards the underside (28) of the hull, and control apparatus (40) that rotates the at least one hydrofoil about the axis in response to roll of the watercraft so as to stabilize the watercraft against the roll. Preferably the axis passes generally through the chord's center.

18 Claims, 3 Drawing Sheets

WATERCRAFT STABILIZATION APPARATUS

FIELD OF THE INVENTION

The present invention relates generally to apparatus and methods for stabilizing watercraft, and particularly to finned apparatus for stabilizing watercraft against roll.

BACKGROUND OF THE INVENTION

Many systems for stabilizing watercraft, such as during pitch and roll, are known. The prior art patent literature describes finned apparatus for stabilizing watercraft against roll. U.S. Pat. Nos. 3,896,755 and 4,061,102, British Patent 1,492,905, Russian Patent 524731, Norwegian Patent 7401864 and French Patent 2,282,364 are believed to be representative of the art.

SUMMARY OF THE INVENTION

The present invention seeks to provide novel finned apparatus for stabilizing watercraft against roll.

There is thus provided in accordance with a preferred embodiment of the present invention stabilization apparatus for a watercraft having a hull, including at least one hydrofoil with a leading edge and a trailing edge, the edges defining a chord extending therebetween, the at least one hydrofoil being mounted below an underside of the hull and arranged for rotation about an axis that is generally perpendicular to the chord and directed towards the underside of the hull, and control apparatus that rotates the at least one hydrofoil about the axis in response to roll of the watercraft so as to stabilize the watercraft against the roll. Preferably the axis passes generally through the chord's center.

In accordance with a preferred embodiment of the present invention the at least one hydrofoil has cambered side surfaces extending from the leading edge to the trailing edge. Additionally or alternatively the at least one hydrofoil has cambered upper and lower surfaces extending from the leading edge to the trailing edge.

Further in accordance with a preferred embodiment of the present invention the control apparatus includes a clinometer that measures roll of the watercraft and the control apparatus receives data from the clinometer and rotates the at least one hydrofoil about the axis in response to the data.

Still further in accordance with a preferred embodiment of the present invention the control apparatus includes a processor that calculates a steady state roll angle of the watercraft and a time derivative of an angle of roll of the watercraft about the steady state roll angle, and the control apparatus rotates the at least one hydrofoil about the axis in response to the time derivative.

Additionally in accordance with a preferred embodiment of the present invention the control apparatus rotates the at least one hydrofoil to at least one predetermined discrete angular position about the axis.

In accordance with a preferred embodiment of the present invention the control apparatus is vibration-isolated mounted to a portion of the watercraft.

The hydrofoil may be mounted on any portion of a keel of the watercraft, such as in front of the keel, aft of the keel, on a starboard or port surface of the keel, or underneath the keel.

Further in accordance with a preferred embodiment of the present invention the at least one hydrofoil is additionally gimbaled for rotation about a fore-and-aft axis of the watercraft.

BRIEF DESCRIPTION OF THE DRAWINGS

The present invention will be understood and appreciated more fully from the following detailed description, taken in conjunction with the drawings in which.

DETAILED DESCRIPTION OF A PREFERRED EMBODIMENT

Figure 1:
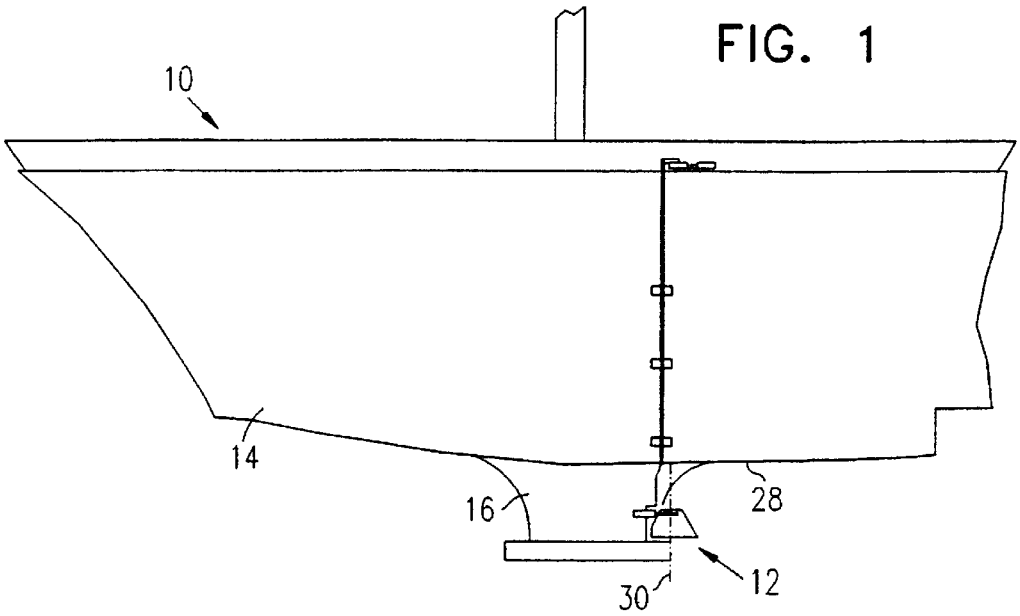
FIG. 1 is a simplified pictorial illustration of a watercraft with stabilization apparatus, constructed and operative in accordance with a preferred embodiment of the present invention.

Reference is now made to FIG. 1 which illustrates a watercraft 10 with stabilization apparatus 12, constructed and operative in accordance with a preferred embodiment of the present invention. Watercraft 10 may be any kind of boat or ship With a water-contacting body or hull 14, and preferably, although not necessarily, has a keel 16 as well.

Figure 2:
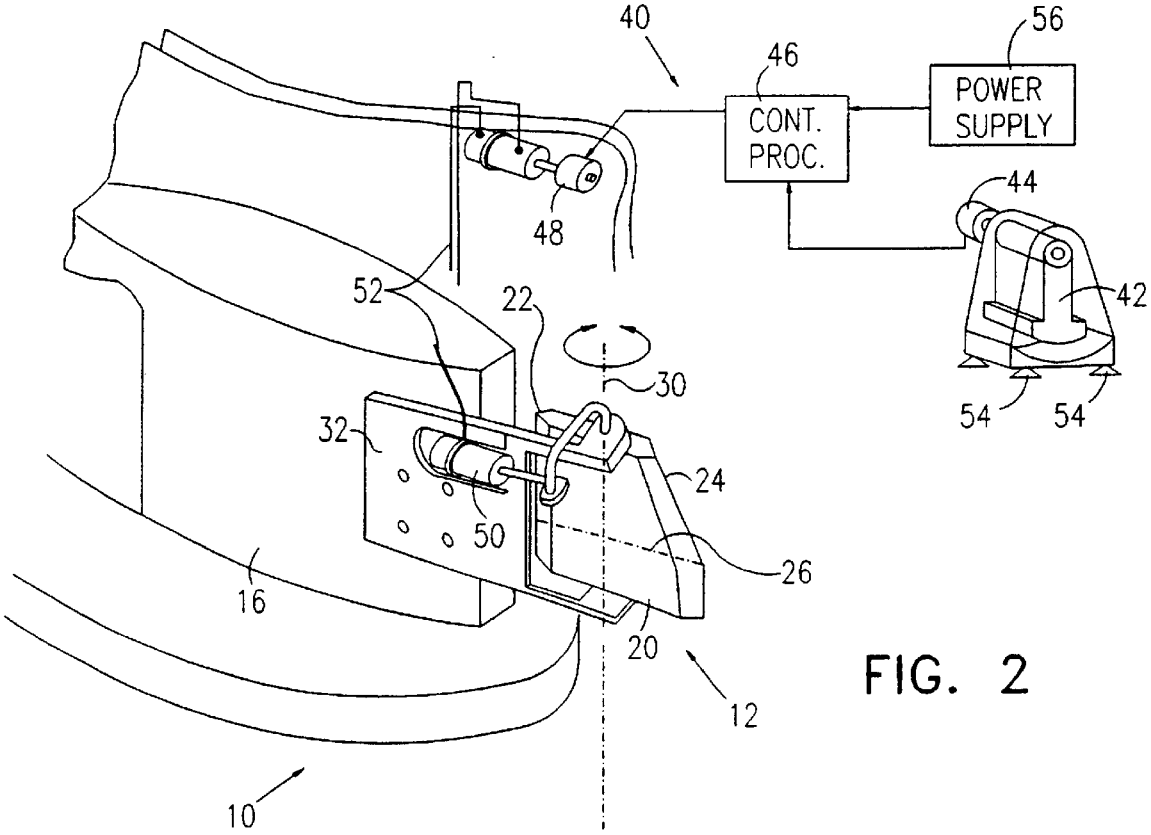
FIG. 2 is a simplified pictorial illustration of the stabilization apparatus of FIG. 1.

Reference is now made to FIG. 2 which illustrates stabilization apparatus 12. Stabilization apparatus 12 includes at least one hydrofoil 20 with a leading edge 22 and a trailing edge 24 that define a chord 26 extending therebetween. Hydrofoil 20 is mounted below an underside 28 (FIG. 1) of hull 14 and arranged for rotation about an axis 30. Axis 30 is generally perpendicular to chord 26 and directed towards underside 28 of hull 14. Preferably axis 30 passes through the center of chord 26, thereby substantially eliminating any moments being imparted to hydrofoil 20 during rotation thereof about axis 30. As seen in FIGS. 1 and 2, hydrofoil 20 is mounted aft of keel 16 and fixedly attached thereto, such as by means of a plate 32 affixed to keel 16. Other alternative mounting configurations of hydrofoil 20 will be described hereinbelow.

Preferably control apparatus 40 is provided for rotating hydrofoil 20 about axis 30. Control apparatus 40 preferably includes a clinometer 42 that measures roll of watercraft 10. Clinometer 42 may be any type of instrument responsive to changes in angle, encompassing such simple instruments as a pendulum or more sophisticated equipment such as an electronic clinometer. Clinometer 42 preferably has an output transducer 44, such as a potentiometer, that transmits angle information to a control processor 46. Control processor 46 uses the data received from clinometer 42 and rotates hydrofoil 20 about axis 30 in response to the data, preferably by means of a pair of above-deck and below-deck actuators 48 and 50, respectively. Clinometer 42, control processor 46 and actuator 48 preferably operate in a closed control loop system. Actuators 48 and 50 may be any type of mechanical, electrical/electronic, pneumatic or hydraulic actuator. Preferably actuator 48 is coupled to actuator 50 by means of cables 52, although any other suitable method of coupling, such as gearing or push/pull rods, may be used so that movement of actuator 48 causes a corresponding movement of hydrofoil 20.

Preferably one or more components of control apparatus 40, such as clinometer 42 or control processor 46, for example, is vibration-isolated mounted to a portion of watercraft 10, such as by means of vibration isolators or shock mounts 54. A power supply 56, such as a battery, preferably powers any or all of the components of control apparatus 40.

Figure 3:
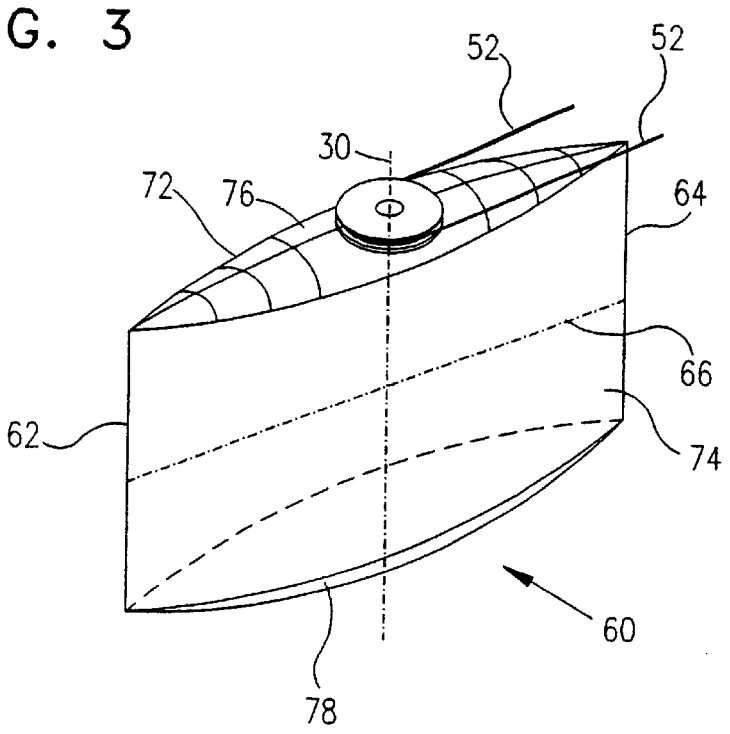
FIG. 3 is a simplified pictorial illustration of a hydrofoil of stabilization apparatus constructed and operative in accordance with another preferred embodiment of the present invention.

Reference is now made to FIG. 3 which illustrates hydrofoil 60, constructed and operative in accordance with another preferred embodiment of the present invention, and which may be used in place of hydrofoil 20 described hereinabove. Hydrofoil 60 has a leading edge 62 and a trailing edge 64 that define a chord 66 extending therebetween. Hydrofoil 60 is arranged for rotation about axis 30 and may rotated thereabout by cables 52 of control apparatus 40 (FIG. 2). Axis 30 is generally perpendicular to chord 66 and preferably passes through the center of chord 66.

Hydrofoil 60 preferably has cambered side surfaces 72 and 74 extending from leading edge 62 to trailing edge 64. Optionally, hydrofoil 60 additionally has cambered upper and lower surfaces 76 and 78, respectively, extending from leading edge 62 to trailing edge 64. The cambered surfaces give hydrofoil 60 a hydrodynamic shape that reduces drag.

Figure 4:
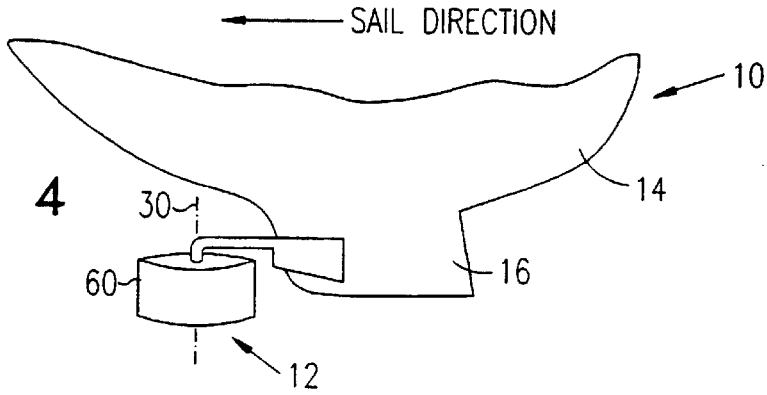
FIGS. 4 and 5 are simplified pictorial illustrations of different mounting configurations of the stabilization apparatus of the present invention on a keel of a watercraft.
Figure 5:
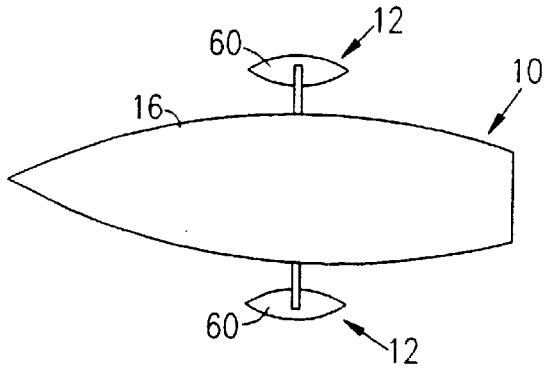

Hydrofoil 20, as shown in FIG. 1, is attached aft of keel 16. Reference is now made to FIGS. 4 and 5 which illustrate different mounting configurations of the stabilization apparatus of the present invention underneath hull 14 of watercraft 10. FIG. 4 illustrates mounting hydrofoil 60 in front of keel 16, while FIG. 5 illustrates mounting a pair of hydrofoils 60 on the port and starboard sides of keel 16. It is appreciated that any other suitable combination of hydrofoils 20 or 60 is within the scope of the present invention.

Figure 6:
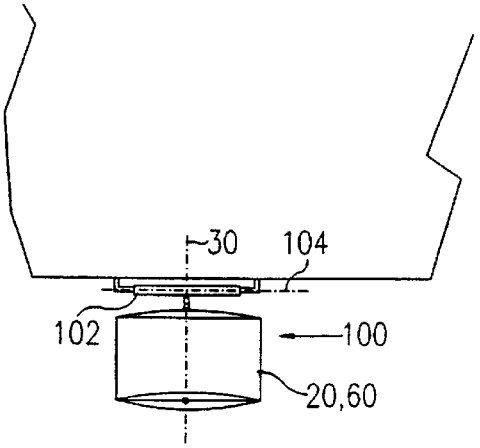
FIGS. 6 and 7 are simplified pictorial illustrations of stabilization apparatus constructed and operative in accordance with yet another preferred embodiment of the present invention.
Figure 7:
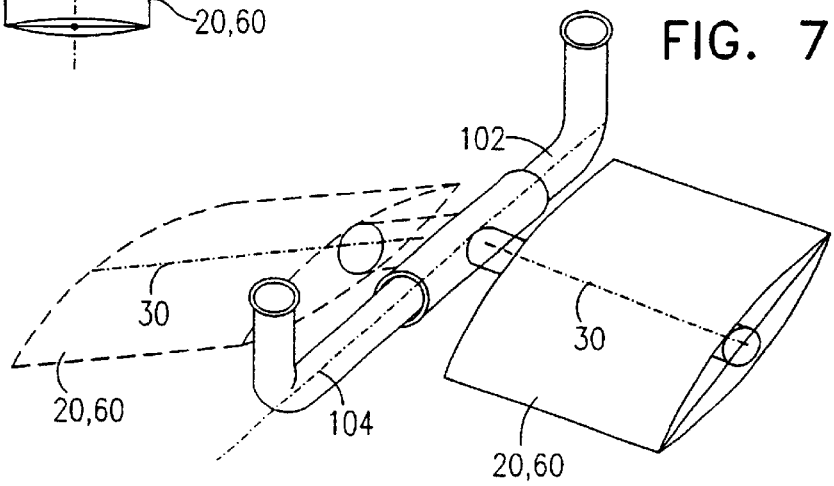

Reference is now made to FIGS. 6 and 7 which illustrate stabilization apparatus 100 constructed and operative in accordance with yet another preferred embodiment of the present invention.

Stabilization apparatus 100 preferably includes a pair of hydrofoils, such as hydrofoils 20 or 60, mounted underneath hull 14 of watercraft 10. In addition to each hydrofoil being arranged for rotation about axis 30, the hydrofoils are pivotally mounted on a gimbal 102 fixedly attached to keel 16, such that the hydrofoils may be rotated by actuator 50 (not shown in FIGS. 6 and 7) about a fore-and-aft axis 104.

Figure 8A:
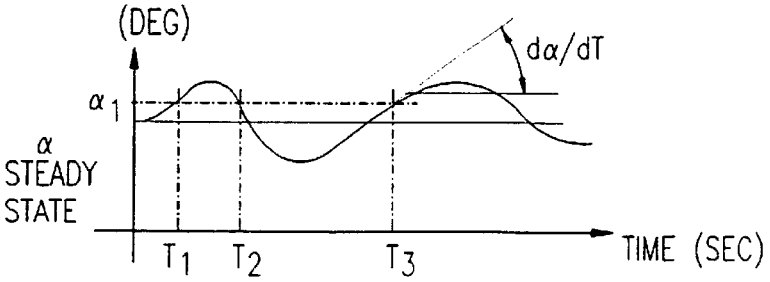
FIG. 8A is a simplified graph of roll angle and time derivative of roll angle as measured and calculated by the stabilization apparatus of the present invention.
Figure 8B:
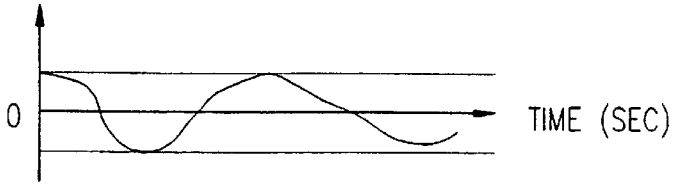
FIG. 8B is a simplified graph of the corrective angular movement of the hydrofoil of the stabilization apparatus of the present invention with respect to time.

The operation of stabilization apparatus 12 will now be described with reference to FIGS. 8A, 8B and 8C, in accordance with a preferred embodiment of the present invention. Preferably control processor 46 (FIG. 2), calculates a steady state roll angle $\alpha$ of watercraft 10 by taking into consideration such factors as size of watercraft 10, load, area of sails (if applicable), sailing direction, strength and direction of wind, inter alia. Control apparatus 46 also calculates a time derivative $d\alpha/dt$ of an angle of roll of watercraft 10 about steady state roll angle $\alpha$, due to the unstable motion of watercraft 10 in the water which may be regular or irregular. As seen in FIG. 8A, a roll angle $\alpha_i$ is measured, such as by clinometer 42 (FIG. 2), at three points in time $T_1$, $T_2$ and $T_3$. These points in time are preferably chosen to cover a typical period of roll movement of watercraft 10, such as 2 seconds, corresponding to a roll frequency of 0.5 Hz. The average of the roll angles $\alpha_i$ measured at $T_1$, $T_2$ and $T_3$ provides the steady state roll angle. Control apparatus 46 then preferably rotates hydrofoil 20 or 60 about axis 30 in response to the calculated time derivative $d\alpha/dt$. FIG. 8B illustrates a typical graph of the corrective angular movement of hydrofoil 20 or 60 about axis 30 with respect to time.

Figure 8C:
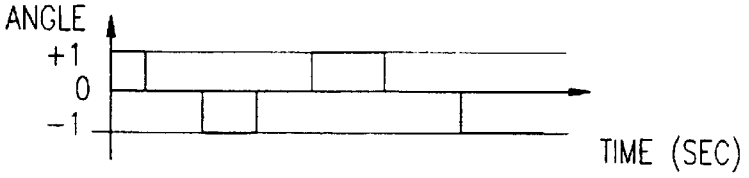
FIG. 8C is a simplified graph of corrective angular movement of the hydrofoil of the stabilization apparatus of the present invention with respect to time, the hydrofoil being rotated to at least one predetermined discrete angular position.

Alternatively, as shown in FIG. 8C, control apparatus 46 may rotate hydrofoil 20 or 60 to at least one predetermined discrete angular position about axis 30 For example, actuators 48 and 50 may be step motors that rotate hydrofoil 20 or 60 in step-like fashion to one of three angles, designated +1, 0 and −1, with 0 corresponding to no rotation about axis 30. The amount of time hydrofoil 20 or 60 remains at any of the discrete angles determines the amount of roll correction.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. Stabilization apparatus (12) for a watercraft (10) having a hull (14), comprising:

at least one hydrofoil (20, 60) with a leading edge (22, 62) and a trailing edge (24, 64), the edges (22, 24, 62, 64) defining a chord (26, 66) extending therebetween, said at least one hydrofoil (20, 60) being mounted below an underside of said hull (14) and arranged for rotation about an axis (30) that is generally perpendicular to said chord (26, 66) and directed towards said underside of said hull (14); and characterized by control apparatus (40) comprising a processor (46) that calculates a steady state roll angle of said watercraft (10) and a time derivative of an angle of roll of said watercraft (10) about said steady state roll angle, wherein a zero roll angle corresponds to an upright position of the watercraft (10), said control apparatus (40) rotating said at least one hydrofoil (20, 60) about said axis (30) in response to said time derivative so as to stabilize said watercraft (10) about said steady state roll angle which does not necessarily correspond to the upright position of the watercraft (10).

2. Apparatus (12) according to claim 1 wherein said axis (30) passes generally through the center of the chord (26, 66).

3. Apparatus (12) according to claim 1 wherein said at least one hydrofoil (60) has cambered side surfaces (72, 74) extending from said leading edge (62) to said trailing edge (64).

4. Apparatus (12) according to claim 1 wherein said at least one hydrofoil (60) has cambered upper and lower surfaces (76, 78) extending from said leading edge (62) to said trailing edge (64).

5. Apparatus (12) according to claim 1 wherein said control apparatus (40) comprises a clinometer (42) that measures roll of said watercraft (10) and said control apparatus (40) receives data from said clinometer (42) and rotates said at least one hydrofoil (20, 60) about said axis (30) in response to said data.

6. Apparatus (12) according to claim 1 and wherein said control apparatus (40) rotates said at least one hydrofoil (20, 60) to at least one predetermined discrete angular position about said axis (30).

7. Apparatus (12) according to claim 1 and wherein said control apparatus (40) is vibration-isolated mounted to a portion of said watercraft (10).

8. Apparatus (12) according to claim 1 and wherein said at least one hydrofoil (20, 60) is mounted on a portion of a keel (16) of said watercraft (10).

9. Apparatus (12) according to claim 1 and wherein said at least one hydrofoil (20, 60) is additionally gimbaled for rotation about a fore-and-aft axis (104) of said watercraft (10).

10. A watercraft (10) comprising:

a hull (14);

at least one hydrofoil (20, 60) with a leading edge (22, 62) and a trailing edge (24, 64), the edges (22, 24, 62, 64) defining a chord (26, 66) extending therebetween, said at least one hydrofoil (20, 60) being mounted below an underside of said hull (14) and arranged for rotation about an axis (30) that is generally perpendicular to said chord (26, 66) and directed towards said underside of said hull (14); and characterized by control apparatus (40) comprising a processor (46) that calculates a steady state roll angle of said watercraft (10) and a time derivative of an angle of roll of said watercraft (10) about said steady state roll angle, wherein a zero roll angle corresponds to an upright position of the watercraft (10), said control apparatus (40) rotating said at least one hydrofoil (20, 60) about said axis (30) in response to said time derivative so as to stabilize said watercraft (10) about said steady state roll angle which does not necessarily correspond to the upright position of the watercraft (10).

11. A watercraft (10) according to claim 10 wherein said axis (30) passes generally through the chord (26, 66)'s center.

12. A watercraft (10) according to claim 10 wherein said at least one hydrofoil (60) has cambered side surfaces (72, 74) extending from said leading edge (62) to said trailing edge (64).

13. A watercraft (10) according to claim 10 wherein said at least one hydrofoil (60) has cambered upper and lower surfaces (76, 78) extending from said leading edge (62) to said trailing edge (64).

14. A watercraft (10) according to claim 10 wherein said control apparatus (40) comprises a clinometer (42) that measures roll of said watercraft (10) and said control apparatus (40) receives data from said clinometer (42) and rotates said at least one hydrofoil (20, 60) about said axis (30) in response to said data.

15. A watercraft (10) according to claim 10 and wherein said control apparatus (40) rotates said at least one hydrofoil (20, 60) to at least one predetermined discrete angular position about said axis (30).

16. A watercraft (10) according to claim 10 and wherein said control apparatus (40) is vibration-isolated mounted to a portion of said watercraft (10).

17. A watercraft (10) according to claim 10 and wherein said at least one hydrofoil (20, 60) is mounted on a portion of a keel (16) of said watercraft (10).

18. A watercraft (10) according to claim 10 and wherein said at least one hydrofoil (20, 60) is additionally gimbaled for rotation about a fore-and-aft axis (104) of said watercraft (10).

* * * * *